US007677054B2

(12) United States Patent
Dos Santos et al.

(10) Patent No.: US 7,677,054 B2
(45) Date of Patent: Mar. 16, 2010

(54) APPARATUS FOR AIR COOLING AND HUMIDIFYING

(76) Inventors: João Henrique Dos Santos, Rua 25 de Fevereiro, 47, Porto Alegre, RS (BR); Ana Luiza Schmidt Dos Santos Lopes, Rua 25 de Fevereiro, 47, Porto Alegre, RS (BR); Pedro Luís Schmidt Dos Santos, Rua 25 de Fevereiro, 47, Porto Alegre, RS (BR)

( * ) Notice: Subject to any disclaimer, the term of this patent is extended or adjusted under 35 U.S.C. 154(b) by 91 days.

(21) Appl. No.: 11/895,041

(22) Filed: Aug. 22, 2007

(65) Prior Publication Data

US 2008/0023857 A1 Jan. 31, 2008

Related U.S. Application Data

(63) Continuation of application No. PCT/BR2006/000270, filed on Dec. 8, 2006.

(30) Foreign Application Priority Data

Jul. 19, 2006 (BR) ..... 8601382 U

(51) Int. Cl.
*F28D 5/00* (2006.01)

(52) U.S. Cl. ..... 62/314; 62/304

(58) Field of Classification Search ..... 62/314, 62/331, 304

See application file for complete search history.

(56) References Cited

U.S. PATENT DOCUMENTS

| | | | | |
|---|---|---|---|---|
| 1,694,453 A | | 12/1928 | Spaudling | |
| 1,966,872 A | | 7/1934 | Simpson | 261/90 |
| 2,653,803 A | * | 9/1953 | Baner | 261/30 |
| 3,583,174 A | * | 6/1971 | Logue | 62/309 |
| 4,810,268 A | * | 3/1989 | Chambers et al. | 95/199 |
| 5,632,159 A | * | 5/1997 | Gall et al. | 62/354 |
| 6,367,278 B1 | * | 4/2002 | Strussion et al. | 62/314 |

FOREIGN PATENT DOCUMENTS

| | | |
|---|---|---|
| CN | 03231691.2 | 4/2009 |
| WO | WO 2005/119130 | 12/2005 |

* cited by examiner

*Primary Examiner*—Melvin Jones
(74) *Attorney, Agent, or Firm*—Clifford Kraft

(57) ABSTRACT

A constructive disposition introduced in air conditioning placed in the technological sector of air conditioning in general, that optimizes mist production as well as providing direction and non-atomized liquid flow generating a more effective and uniform mist in the gravitational area besides ensuring more security in its use avoiding accidents to users when near the equipment.

Therefore, constructive disposition introduced in air conditioning is comprised by a cabinet (1) with a centrally positioned electrical motor (2) that presents a propeller (3) connected in the preceding edge of its motor shaft, which connects to the spinning disc (4) on the other edge, running centrally through the water collector calotte (5), which has peripheral radial grooves and is complemented by a condensed liquid collector (6) interconnected to a storage (7) placed inside the casing provided of a liquid entrance tubing (8) and wherein it is placed the buoy set (9) and liquid pump (10), which has tubing (11) interconnected to the regulator register (12) with liquid liberation hose (13) along with disc internal surface (4), characterized by the fact the water collector calotte (5) has peripheral radial grooves in a curve shape (14); and by the fact that the spinning disc (4) is overlapped by a protector calotte and mist filter (15), properly fixed along with water collector calotte (5).

13 Claims, 4 Drawing Sheets

APPARATUS FOR AIR COOLING AND HUMIDIFYING

This application is a continuation of co-pending PCT application number PCT/BR2006/000270 filed Dec. 8, 2006 naming the United States. Application PCT/BR2006/000270 claimes priority to Brazilian application number MU 8601382-3 filed Jul. 19, 2006. Applications PCT/BR2006/000270 and MU 8601382-3 are hereby incorporated by reference.

BACKGROUND

1. Technological Sector

The present invention refers to the technological sector of air conditioning in general, where it will ensure a new constructive and functional activity optimizing mist production as well providing direction and non-atomized liquid flow generating a more effective and uniform mist besides ensuring more security in its use, avoiding accidents to users when near the equipment.

The present invention has as an object a constructive disposition introduced in air conditioning carefully and substantially designed intending to characterize something really new and able to occupy a distinguished place when compared to models already known in the state of art in this technological area, namely a new type of air conditioning fan and mister.

2. State of Art

It is known through the state of art that there are today models of equipment designed for air conditioning that employ systems of injection nozzles and sprays to produce mist which have already demonstrated as not being efficacious when applied in these types of devices.

Injection nozzle systems require pressurized lines where they provoke considerable load loss and that need a high pressure pump producing obstruction and generating high energy consumption reflecting on the equipment final price.

Centrifugal-like sprays that act through the action of a spinning disc and a fan, producing a vacuum in the preceding portion of the equipment where there is excessive liquid dripping to be condensed, which is collected in the lower part of the equipment are not efficacious for this type of procedure since existent radial grooves cannot properly drain the liquid thus producing dripping and wetting the area near the equipment which may cause damages to user products or equipment which may be in the spray working area.

Another problem found with current centrifugal-like spray equipment is in the fact that the spinning disc is placed in the front part of the equipment with no protection; this leads to accident risks to the user when handling it making it possible to catch fingers or hair during the spinning disc rotation resulting in injuries even to the user's face.

Adopting protection bars might solve the problem, but it provokes liquid condensation in its structure resulting in dripping and wetting the area near the equipment which is undesirable since that may cause damages to the workplace where it is operating.

NEWS AND OBJECTIVES OF THE INVENTION

Therefore, an aim of the present invention is characterizing a constructive disposition introduced in air conditioning which will solve the problems presented, ensuring suitable non-vaporized liquid guiding and flowing through use of a water collecting calotte provided of peripheral and radial grooves properly designed in a curve form and disposed along to its inner border. Another aspect of the present invention is the fact that it ensures the user security without risks of the spinning disc through incorporation of a calotte fixed in the equipment protecting against accidents and placed in front of the spinning disc, which besides the security function, also functions as a mist filter because it retains bigger drops non-atomized by the spinning disc thus avoiding sprinkling on the area near air conditioning operation.

ADVANTAGES OF THE INVENTION

Advantages from the present invention are clear. We can mention as the main advantages among many others the following: it avoids accidents caused by the spinning disc due to the fixed protector calotte; it ensures non-vaporized liquid flowing towards the equipment reservoir so that it does not allow drop formation on the water collector calotte border; it presents an element of sprinkles contention through the protector calotte border that additionally functions as a mist filter.

DESCRIPTION OF THE FIGURES

By aiming at clarifying and illustrating the essence of the mentioned model that refers to a constructive disposition introduced in air conditioning according to a basic and preferential form of performing designed by the applicant, it is referred to attached drawings that are part of and subsidize the present descriptive report.

Therefore.

Figure 1:
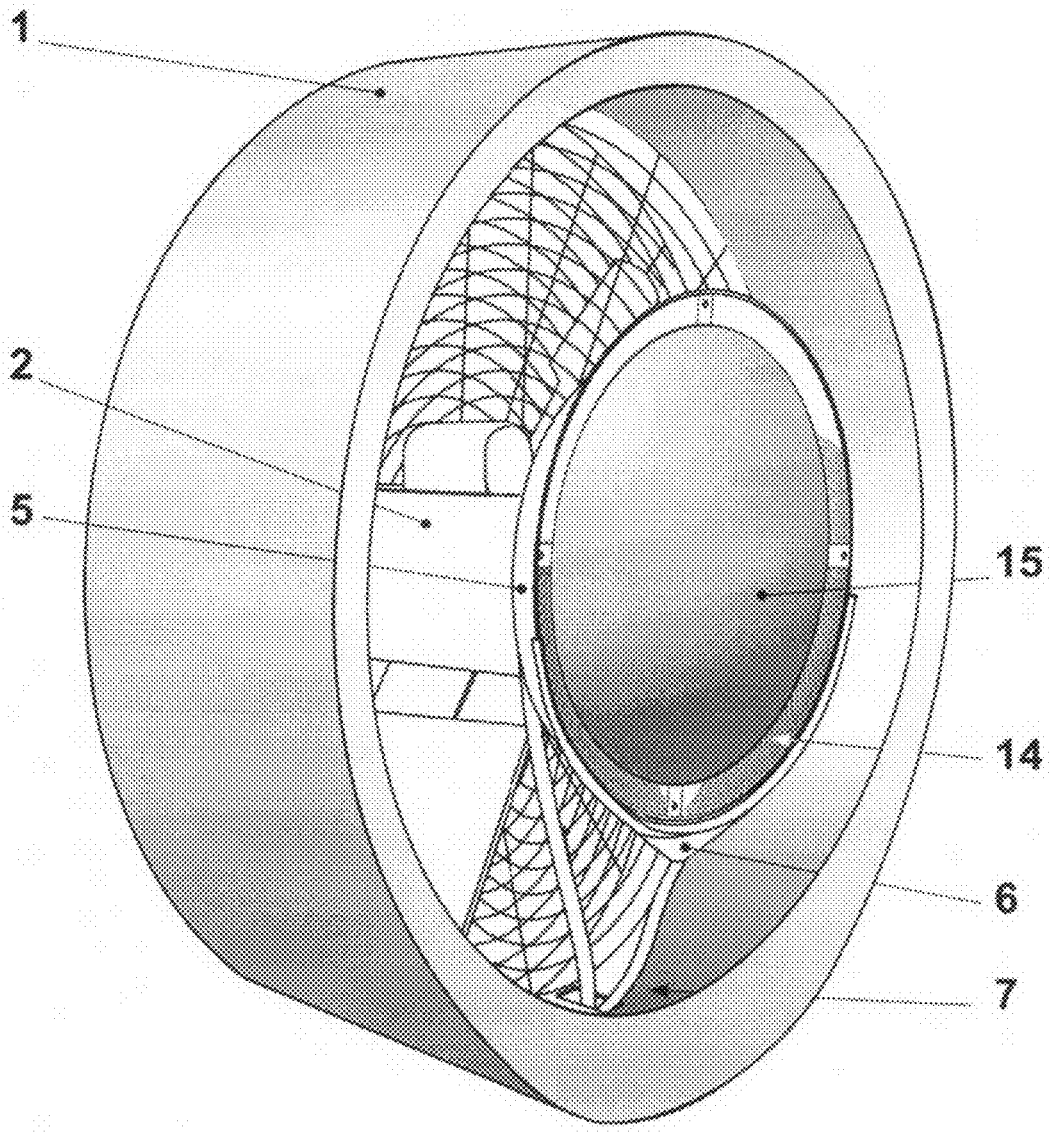
in FIG. 1, a perspective view of the equipment wherein is presented the existence of radial grooves and the protector calotte and mist filter proposed in this invention.
Figure 2:
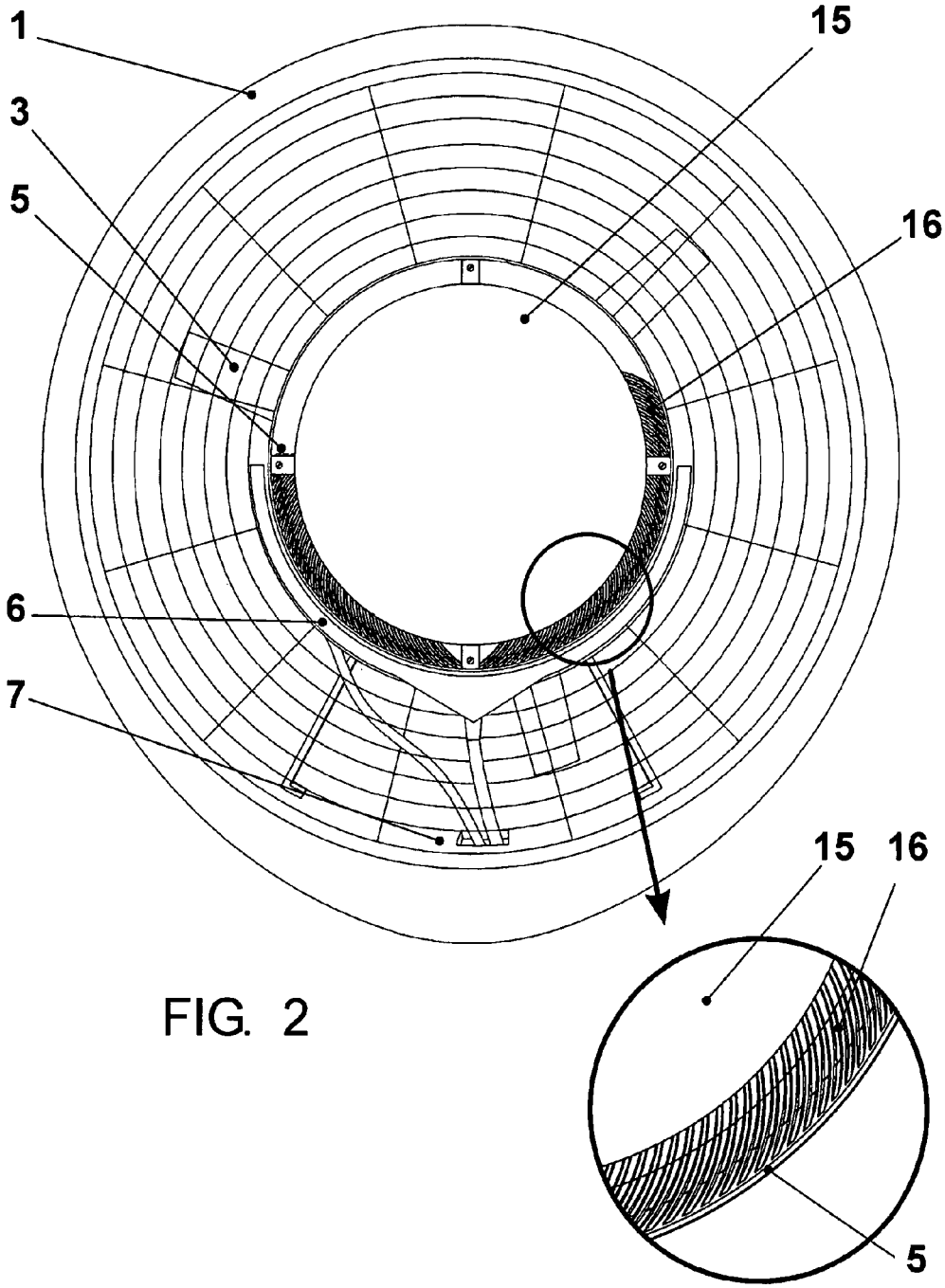
in FIG. 2, a cut view referred to FIG. 1, wherein is presented both grooves and protector calotte and mist filter.

Although the present model is depicted together with this presented preferential substantiation, it is understood its constructive characteristics are not limited to this solution.

On the contrary, it is proposed that all alternatives, variations, modifications and equivalents will be reached in a way they can be included in the scope of the present invention.

DETAILED DESCRIPTION OF THE INVENTION

According to what may be inferred by the analysis of the attached figures constructive disposition introduced in air conditioning, according to alleged by the present invention, characterized by comprehending in a basic and essential way a cabinet (1) wherein is centrally positioned an electrical motor (2) that presents a propeller (3) connected to one end of its motor shaft, and connected to a spinning disc (4) on the other end, running centrally through the water collector calotte (5) which has peripheral radial grooves (14) and is complemented by a condensed liquid collector (6) interconnected to a storage area (7) placed inside the casing provided with liquid drain tubing (8) and wherein is placed a buoy set (9) and liquid pump (10) which has tubing (11) interconnected to the regulator register (12) with a liquid liberation hose (13) along with a disc internal surface (4), and characterized by the fact the water collector calotte (5) has peripheral radial grooves in a curved shape (14); and by the fact that the spinning disc (4) is covered by a protector (safety cover) calotte and mist filter (15), properly fixed along with water collector calotte (5).

Figure 6:
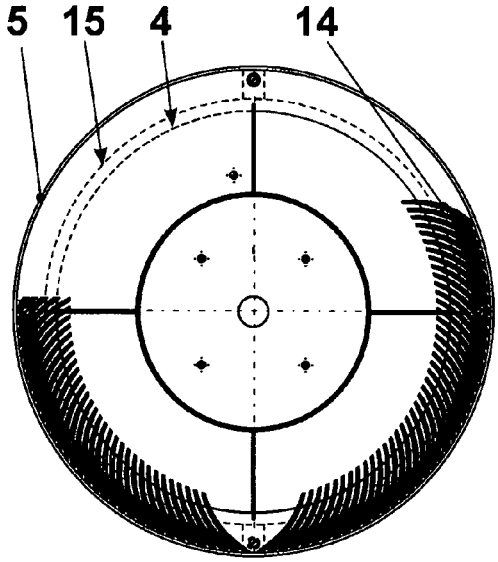

The grooves (16) in the collector calotte run partially radially and partially angularly downward and outward as shown in FIG. 6. Each of these grooves is part of an arc, which if extended, would intersect a plane drawn fore and after through the center of the motor (2).

FUNCTIONALITY DESCRIPTION

The functionality of the proposed disposition introduced in air conditioning may be depicted as it follows: as the liquid atomization starts there is partial condensation along with water collector calotte border (5), being led by curve grooves (14) with better direction and flowing to the collector (7), without drops appearing on the calotte border (5).

During the air conditioning process, the protector calotte (15) prevents the user from having contact with the spinning disc (4) avoiding risks of accidents, and as well as it functions as a mist filter through retaining bigger drops that were not atomized in the process.

The present invention is a disposition introduced in air conditioning as it can be seen through analysis, followed by attached drawings that depicted it, having the new characteristics related to all that is known in the state of art in such technological area.

The invention claimed is:

1. An air moving fan an mister comprising:

a housing containing a motor, said motor having a shaft with first and second ends;

a plurality of fan blades rigidly attached to said first end of said shaft;

a disk rigidly attached to said second end of said shaft, whereby said plurality of fan blades and disk rotate when driven by said motor;

a water-collecting calotte mounted between said disk and said motor, wherein said calotte contains a plurality of grooves, wherein said grooves are arcuate;

a water reservoir and pump supplying water onto said disk as the disk spins causing a misting effect;

a water collector mounted below said calotte that collects water and returns it to said reservoir.

2. The air moving fan and mister of claim 1 wherein said grooves have downward and outward direction.

3. The air moving fan and mister of claim 1 wherein each of said grooves is part of an arc that intersects and extended vertical symmetry plane running fore and aft that cuts through said motor centrally.

4. A method of air cooling and misting comprising:

providing a rotating propeller on a first end of an electric motor and a rotating disk on a second end of said motor;

applying a flow of water from a reservoir to an inside surface of said disk as said disk rotates;

providing a water collecting calotte with a plurality of partially radial grooves behind said disk, wherein each of said grooves is part of an arc that intersects an extended vertical symmetry plane running fore and aft that cuts through said motor centrally;

collecting water from a lower end of said calotte;

returning said water to said reservoir.

5. The method of claim 4 wherein said flow of water is provided by a pump coupled to said reservoir.

6. An arrangement applied to an air cooling and humidifying device, characterized by a chamber (1) that contains internally and centrally an electrical motor (2) on whose shaft a fan (3) with several blades is connected to a rear extremity, and a spinning disc (4) is connected to a front extremity, said disk being provided with curved peripheral radial grooves (14) and working in rhythm with a water collector (6) interconnected with a storing receptacle (7) located in an inner and lower portion of the chamber (1), said storing receptacle having a liquid return hose (8) in which a float (9) and a liquid pump (10) are located, said pump connected to a flow regulator (12) with a liquid releasing hose (13) located in proximity to an inner portion of the disc (4), said disk having a protection and fog filter cap (15); the arrangement characterized in that it is actuated by the electric motor (2) impelling the fan (3) and the spinning disc (4), the fan and disk positioned on the opposed extremities of the shaft, a regulator adjusting the flow of the pressure of the water coming from the storing receptacle (7) located in the lower portion of the chamber (1) through a hose (11), which is expelled against a water collection cap (5) on the spinning disc (4) producing a jet of constant humidified fog, thus humidifying and cooling concentrated air and, as a result, renewing it.

7. The arrangement according to the claim 6 characterized by a water collection cap (5) of cylindrical configuration and provided with curved-shaped peripheral radial grooves (14).

8. The arrangement according to the claim 7, wherein the collection cap (5), in its lower portion, contains an unevaporated liquid collector (6) in such a manner that said liquid collector recovers excess unprocessed liquid and sends it back to the storing receptacle (7) through said return hose (8).

Figure 3:
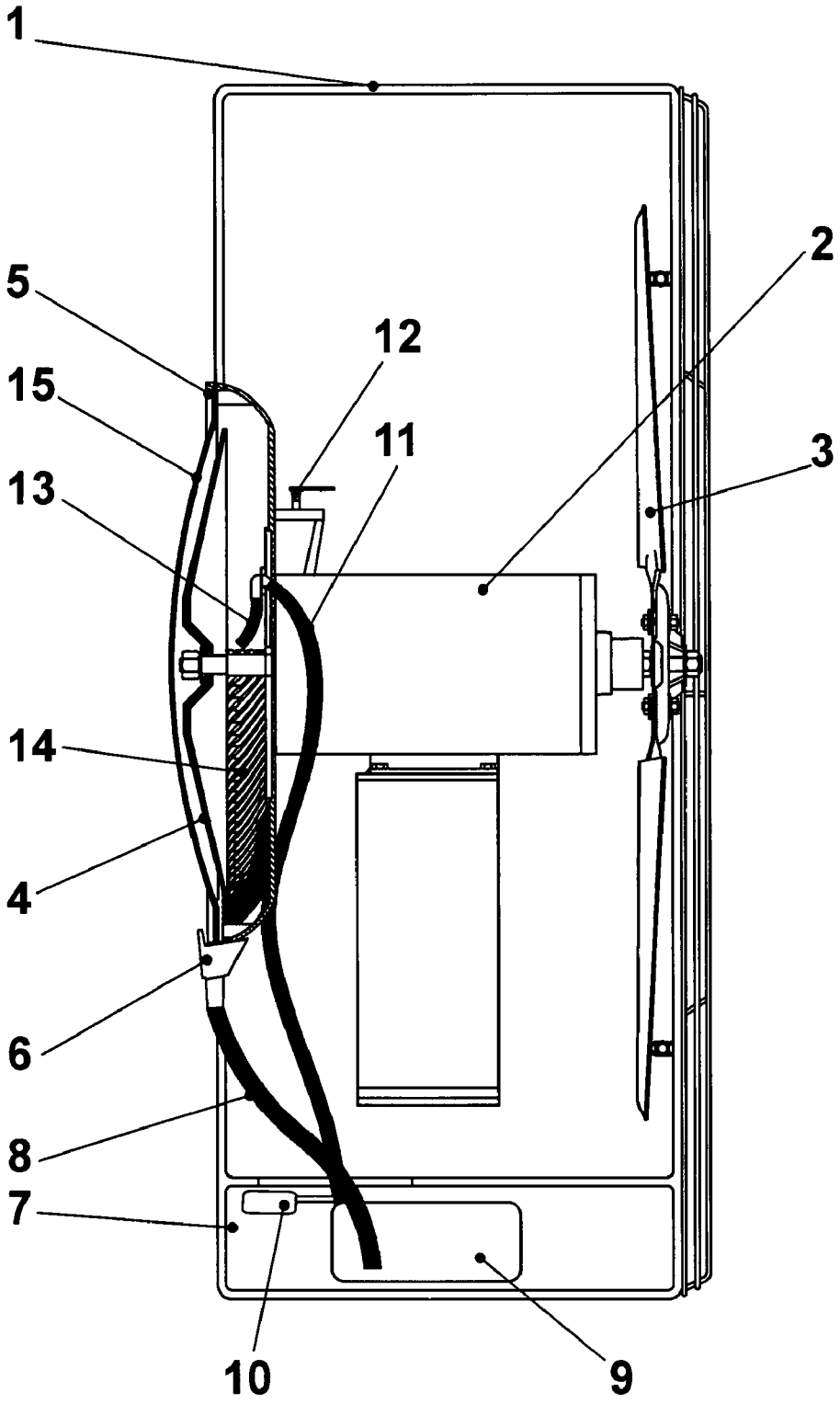
in FIG. 3, a front view referred to FIG. 1, wherein is presented the existence of radial grooves and the protector calotte and mist filter proposed in this invention.
Figure 4:
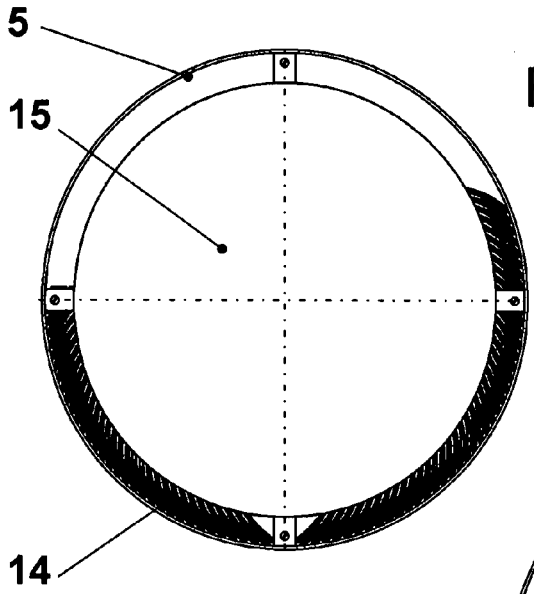
in FIG. 4, a detailed view of the water collector calotte with the spinning disc and protector calotte over the proposed curved grooves.
Figure 5:
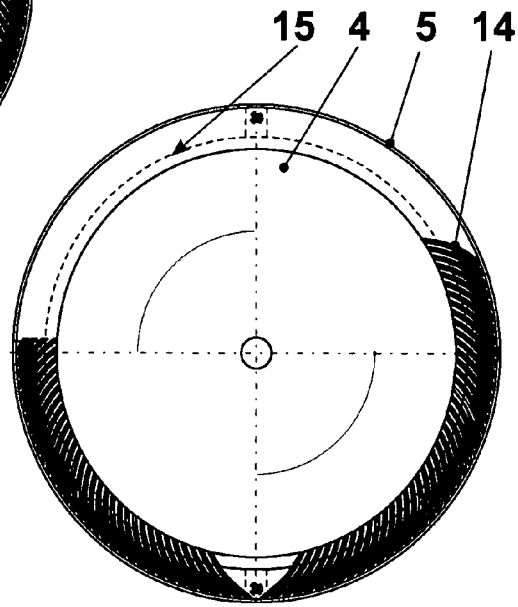
in FIG. 5, a view referred to FIG. 4 now with protector calotte in dashed to better show the spinning disc and the proposed grooves; and, in FIG. 6, a view referred to FIG. 4, with spinning disc and protector calotte in dashed to better show the proposed curve grooves.

9. The arrangement according to the claim 8, characterized in that it is furnished with a smooth surface spinning disc (4) and fixed centrally onto the front extremity of the shaft of the electrical motor (2) whose actuation in conjunction with the fan (3) arranged on the other extremity of said shaft of the electrical motor (2) produces evaporation of the liquid expelled by the hose (13) through the water collection cap (5) provided with peripheral radial grooves (14), said water coming from the storing receptacle (7) through the hose (11) ensuring adjustment of the regulator (12) in order to form humidified fog (FIG. 3).

10. The arrangement according to the claim 9, characterized in that it employs a cap (15) that is fixed onto the spinning disc (4) which protects against a risk of accidents through introduction of a user's hand into to the spinning disc (4) when in operation, and, on the other hand, acts as a fog filter retaining larger liquid drops unatomized and unprocessed, directing them to the collector (6) that sends them back to the storing receptacle (7) through the return hose (8).

11. The arrangement according to the claim 10, including an arrangement of a float (9) and a liquid pump (10) interconnected with the return hose (8) and liquid outlet (11).

12. The arrangement according to the claim 11, characterized in that the peripheral radial grooves (14) arranged on the water collection cap (5) are part of an arc that crosses an extended plane of inclined vertical symmetry, and that runs fore and aft along the shaft of the electrical motor (2), said plane positioned on said shaft's front extremity traversing said chamber centrally.

13. The arrangement according to the claim 12, characterized in that said fan is provided with a safety grid positioned in the rear portion of the chamber (1).

* * * * *